US006409841B1

(12) United States Patent
Lombard

(10) Patent No.: US 6,409,841 B1
(45) Date of Patent: Jun. 25, 2002

(54) PROCESS FOR THE PRODUCTION OF ORGANIC PRODUCTS FROM DIVERSE BIOMASS SOURCES

(75) Inventor: Charles K. Lombard, East Palo Alto, CA (US)

(73) Assignee: Waste Energy Integrated Systems, LLC., Palo Alto, CA (US)

( * ) Notice: Subject to any disclaimer, the term of this patent is extended or adjusted under 35 U.S.C. 154(b) by 0 days.

(21) Appl. No.: 09/705,424

(22) Filed: Nov. 2, 2000

Related U.S. Application Data

(60) Provisional application No. 60/136,117, filed on Nov. 2, 1999.

(51) Int. Cl.[7] ..... C13K 1/02; C13D 1/00

(52) U.S. Cl. ..... 127/37; 127/36; 127/43; 162/1; 162/25; 426/1; 426/2

(58) Field of Search ..... 127/36, 37, 43; 162/1, 25; 426/1, 2

(56) References Cited

U.S. PATENT DOCUMENTS

| | | | | | |
|---|---|---|---|---|---|
| 4,436,586 | A | | 3/1984 | Elmore | 162/19 |
| 5,221,357 | A | * | 6/1993 | Brink | 127/43 |
| 5,562,777 | A | * | 10/1996 | Farone et al. | 127/37 |
| 5,628,830 | A | * | 5/1997 | Brink | 137/36 |
| 5,705,216 | A | | 1/1998 | Tyson | 426/478 |
| 5,705,369 | A | | 1/1998 | Torget et al. | 435/105 |

FOREIGN PATENT DOCUMENTS

| | | | |
|---|---|---|---|
| CA | 1526621 | * | 9/1978 |
| GB | 1 526 621 | | 9/1998 |

OTHER PUBLICATIONS

Ogier, et al., "Production d'éthanol á partir de biomasse lignocellulosique", Revue de l'institut Francais du Petrole, FR, Editions Technip. Paris, vol. 54, No. 1, Jan. 1999, pp. 67–94.

Gusakov, et al., "Factors Affecting the Enzymatic Hydrolysis of Cellulose in Batch and Continuous Reactors: Computer Simulation and Experiment", Department of Chemistry, Accepted for publication Sep. 2, 1996, vol. XXIX, pp. 906–910.

Gusakov, et al., "Kinetics of the Enzymatic Hydrolysis of Cellulose: 2. A Mathematical Model for the Process in a Plug–Flow Column Reactor", Department of Chemistry, Received Oct. 2, 1984; revised Dec. 12, 1984, vol. 7, pp. 383–388.

Gusakov, et al., "A Theoretical Comparison of the Reactors for the Enzymatic Hydrolysis of Cellulose", Department of Chemistry, Accepted for publication Sep. 2, 1986, vol. XXIX, pp. 898–900.

Li, et al., "Thermoplastics with Very High Lignin Contents", Department of Wood and Paper Science, 1998, pp. 1–11.

Lombard, Charles K., Project Manager, Waste Energy Integrated Systems. *Techno–Economics of the WEIS Biomass Ethanol Process*[Final Report for Project: Enzymatic Utilization of Cellulose in a Continuous Bimembrane Reactor]. National Renewable Energy Laboratory Subcontract No. ACG–7–17021–01, Jun. 26, 1998.

Nguyen, Quang A.; Keller, Fred A.; Tucker, Melvin P.; Lombard, Charles K.; Jenkins, Bryan A.; et al. Bioconversion of mixed solid waste to ethanol. *Applied Biochem. Biotechnol.* 77–79: 455–472, 1999.

Brink, et al., "Aspects of Economics of a Small Sized HFC Process Plant for Manufacture of Ethanol from Renewable Biomass", University of California at Berkeley, Forest Products Laboratory, Aug. 7, 1992, pp. 1–10.

Brink, et al., "Ethanol Fuel, Organic Chemicals, Single–Cell Proteins: A New Forest Products Industry", Proceedings of the Symposium on Multiple–Use Management of California's Hardwood Resources, Nov. 12–14 1986, pp. 236–243.

* cited by examiner

*Primary Examiner*—Jeffrey Fredman
*Assistant Examiner*—Suryaprabha Chunduru
(74) *Attorney, Agent, or Firm*—Beyer Weaver & Thomas LLP

(57) ABSTRACT

Disclosed are processes and systems for the production of useful organic product from diverse lignocellulose-containing biomass having increased yield and efficiency over existing processes. In particular, the present invention integrates dilute acid hydrolysis and alkaline delignification techniques in processes that enhance the efficiency and yiel of lignocellulostic biomass processing and enable the economic production lignin-based biodegradable plastics and other useful organic products.

35 Claims, 3 Drawing Sheets

PROCESS FOR THE PRODUCTION OF ORGANIC PRODUCTS FROM DIVERSE BIOMASS SOURCES

CROSS-REFERENCE TO RELATED APPLICATIONS

This application claims priority from U.S. Provisional Application Ser. No. 60/163,117, entitled HIGH-YIELD, CONTINUOUS PROCESS FOR THE PRODUCTION OF ORGANIC PRODUCTS FROM DIVERSE BIOMASS SOURCES, filed Nov. 2, 1999, the disclosure of which is herein incorporated by reference herein for all purposes.

BACKGROUND OF THE INVENTION

The present invention relates to the production of useful organic products from diverse biomass. In particular, the invention relates to the large-scale production of organic products such as sugars, ethanol, lignan and derivative biodegradable thermoplastics from agricultural, forestry and municipal wastes, in an energy efficient and environmentally sensitive manner.

Mixed municipal solid waste (MSW) typically constitutes about two-thirds organic biomass materials and is rarely disposed other than by costly, environmentally polluting incineration or landfilling. A widespread approach to partially reducing the volume of cellulosic solid wastes going into landfill is through composting, particularly of source separated "greenwaste" that includes yard waste, vegetable material and mixed waste paper. Composting involves natural aerobic fermentation under the action of bacteria, yeast and fungal organisms and their enzymes that in commercial practice degrade principally the carbohydrate and hemicellulose polysaccharide components of biomass. The result is a volume reduction by about one-third of solid waste and a comparatively low-value, highly cellulosic, water-shedding residue, marketed as a soil amendment—"compost." The value of this product rarely pays the cost of disposal, and the substantial tipping fee-subsidized market often involves negative revenue to transport for spreading on agricultural lands or landfill incorporation.

Many attempts have been made to improve upon existing biomass processing techniques in order to improve the efficiency of processing and the yield of useful organic materials obtained.

U.S. Pat. No. 4,110,281 to Dreer is directed toward producing a variety of value-added material products as an alternative to low-value disposal. Dreer describes a process for reducing MSW to compost in which the MSW is ground, extracted of metal and further chemically processed with organic solvents and resin.

U.S. Pat. No. 5,326,477 to Fuqua et al. describes a process directed toward volume reduction and sewage disposal of certain high cellulose content solid waste, such as disposable diapers and pads, by liquefaction through enzymatic breakdown in a cellulase solution. The process conditions given are such as to support rapid, partial fragmentation of the cellulosic polymer chains sufficient to render the material suitable for liquid transportable discharge through a pipe. Provision is made to capture a plastic shell (film) for prospective recycling.

U.S. Pat. No. 5,705,216 to Tyson discloses methods of alkaline pulping using a mechanical extruder to crush and feed NaOH-soaked biomass wastes, such as wood and agricultural residues, into a pressure chamber where, under the action of saturated steam in the 200° C. regime, the material is digested for several minutes. Tyson's process is terminated by sudden pressure release (steam explosion) on the digested material as it exits the extruder. The process, with variants, is directed to the partial solubilization of lignin and hemicellulose and the disruption of the lignocellulosic matrix of biomass with the principal purpose of creating a reactive, absorbent, fibrous material. This product aims to serve a variety of purposes from ruminant animal feed to composite alternative structural materials (with or without the addition of recycled thermoplastics). Another aim of the invention is to extract from the treated fiber a solubilized portion of the polymeric constituents lignin and hemicellulose, together comprising an extractable weight reduction of about 32% of the feedstock material. Typically, hemicellulose and lignin together comprise about 50% of biomass feedstock materials. In Tyson's process, the extracted portion of the hemicellulose is optionally available to subsequent enzymatic hydrolysis to sugars with prospective fermentation to ethanol and organic acids.

Alternatively, U.S. Pat. No. 4,728,367 to Huber describes an extruder device and a process for either strong or dilute acid pretreatment directed toward providing partial solubilization and hydrolysis of hemicellulose from lignocellulosic materials. Under comparatively elevated temperatures and pressures and very short acid contact times of several seconds, Huber indicates glucose production of a modest 13–20% of feedstock.

Another approach to biomass chemical decomposition directed toward sugar production for subsequent fermentation to ethanol has been described in the U.S. Pat. No. 5,221,357 to Brink. The Brink patent gives a two-stage dilute acid hydrolysis process preferably with nitric acid and carried out under saturated steam in a pressure reactor. The first stage hydrolysis is performed under comparatively mild conditions of pH (about 2), temperature (about 185° C.) and pressure (about 10 atmospheres). The aim of the first stage is to solubilize, hydrolyze and extract most of the hemicellulose from the lignocellulosic matrix while not substantially degrading the cellulose and liberated monomeric sugars. This aim is achieved in several minutes digestion time with the result of solubilizing and enabling the extraction of about 30% of the biomass feedstock material, leaving lignin and much of the cellulose intact.

After acting to separate the solubilized five- and six-carbon sugars of the hemicellulose, the Brink process then addresses the more difficult issue of hydrolysis and solubilization of the cellulose polysaccharide under more extreme conditions of lower pH, temperature over 200° C. and pressure 20 atmospheres for over 10 minutes. Under carefully tailored conditions for a given homogeneous feedstock, sugar production and degradation can be optimized to yield a total about 60% of potential sugars in the two-stage dilute acid process.

Other innovations the Brink process introduces are, first, solvent extraction of high-boiling-point coproduct chemicals—particularly furfural and acetic acid—from the sugar-containing liquid hydrolysate of the first stage before fermentation. Second, the process incorporates mechanical refinement of the first stage pretreated solids in a device (described in U.S. Pat. No. 4,206,903 to Brink).

An additional disruptive process for terminating the first stage in a steam explosion decompression through a decompression orifice is disclosed in subsequent Pat. No. 5,628,830 to Brink ('830 patent). The patent describes an alternative process directed toward increasing sugar and ethanol yield through a second hydrolysis of the lignocellulosic solids from the first stage by enzymatic digestion. Relative to Brink's '903 patent, his enzymatic process replaces the second stage dilute acid hydrolysis of cellulose under more severe conditions than the first stage hydrolysis of hemicellulose. The '830 patent reveals that, with the combined mechanical refinement and steam explosion disintegration, a preponderance of the solid particles is smaller than about 100 mesh for typical woody substrates. Further, the '830 patent description reveals that, at cellulase enzyme loading of about 13.5 FPU/gm on mixed New York hardwood substrate, at low, and with about 5% solids loading in aqueous carrier, the process-implemented batch simultaneous saccharification and fermentation (SSF) with *S. cereviseae* yeast is capable to yield 89.2% cellulose-to-ethanol conversion in 4 days. One of skill in the art will understand that the combination of low solids loading and SSF fermentation act together to limit buildup of sugar concentrations in the reactor and contain so-called end product inhibition of enzymatic hydrolysis. Accordingly, Brink's results indicate a significant speedup in batch enzymatic hydrolysis of dilute acid pretreated lignocellulose solids substrate vis-à-vis the comparative literature, heretofore.

Adding the fermentation of extracted sugars from first dilute acid hydrolysate using the five- and six-carbon sugar metabolizing organism *Pitchia stipititis*, Brink further reveals capability for a total ethanol yield from the combined process of 561 lb/ton or 85 gal/ton feedstock.

In another technology advance, U.S. Pat. No. 5,036,005 to Tedder describes an invention directed toward efficient, continuous fermentation of sugars with continuous solvent extraction of both ethanol and volatile organic coproducts from a biocatalyst-containing fermentation broth. The invention poses the opportunity to economically recover volatile organic coproducts and ethanol with low expenditure of energy and capital cost, while also avoiding additional investment in drying to fuel grade ethanol. The tightly integrated system requires the use of a solvent that conventionally has a higher boiling point than the products to be extracted and also is nontoxic to the fermentation organisms the solvent intimately contacts. The latter constraint obviates the use of otherwise attractive higher alcohols as solvents.

Despite these efforts, the extent productization and yields from biomass processing, particularly from biomass with a significant lignocellulostic component, remain relatively low or are achieved at uneconomic expenditure of time, process volumes and expensive catalysts. Cost-effective large-scale biomass processing techniques are lacking. While previous approaches have advanced the understanding of biomass processing and its yields, improved biomass processing techniques and systems would be desirable.

SUMMARY OF THE INVENTION

The present invention achieves further advances in biomass processing by providing processes and systems for the increased production of useful organic products from diverse lignocellulose-containing biomass. In particular, the present invention integrates dilute acid hydrolysis and alkaline delignification techniques in processes that enhance the quantity of products, i.e., material utilization efficiency and yield, of lignocellulostic biomass processing and enable the economic production lignin-based biodegradable plastics and other useful organic products.

The invention integrates technologies in chemical processing to achieve exceptional product yields, value added and productivity in the production of sugars, ethanol, lignin, other (photosynthetically) plant-derived organic chemicals, and process-derived biocatalyst proteins from a diverse spectrum of commonly occurring biomass sources. These prominently include wastes (residues) of agricultural, forest/mill and municipal origin. Synergistically sharing process costs while supporting (maximizing) added value in multiple products, the invention poses the prospect to newly render highly cost-effective the large-scale remanufacture (reuse) of the organic products of human activities.

Processes in accordance with the present invention may also prominently feature environmentally benign attributes of energy efficiency, material (e.g., water) conservation and avoids chemical nuisance/toxicity, which, together with the theme of renewable materials products, contribute to the objectives of sustainable ecology.

In one aspect, the present invention provides a method of processing a lignocellulose-containing biomass material. The method involves treating the biomass material by dilute acid hydrolysis and treating an unreacted lignocellulostic component of the acid hydrolyzed biomass material by alkaline delignification. In many implementations of the invention, these processing techniques will be combined with others to provide for efficient, high-yield processing of lignocellulostic biomass. Other aspects of the invention also provide systems configured for processing a lignocellulose-containing biomass material in accordance with the method of the present invention.

These and other features of the invention will be further described and exemplified in the drawings and detailed description below.

DETAILED DESCRIPTION OF PREFERRED EMBODIMENTS

Reference will now be made in detail to preferred embodiments of the invention. Examples of preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known process operations have not been described in detail in order not to unnecessarily obscure the present invention.

INTRODUCTION

The present invention achieves advances in MSW processing by providing processes and systems for the production of useful organic products from diverse lignocellulose-containing biomass having increased yield and efficiency. In particular, the present invention integrates dilute acid hydrolysis and alkaline delignification techniques in processes that enhance the material utilization efficiency and yield of lignocellulostic biomass processing.

The invention integrates technologies in chemical processing to achieve exceptional product yields, value added and productivity in the production of sugars, ethanol, lignin and derivative biodegradable thermoplastics, other (photosynthetically) plant-derived organic chemicals, and process-derived biocatalyst proteins from a diverse spectrum of commonly occurring biomass sources. These prominently include wastes (residues) of agricultural, forest/mill and municipal origin. Synergistically sharing process costs while supporting (maximizing) added value in multiple products, the invention poses the prospect to newly render highly cost-effective the large-scale remanufacture (reuse) of the organic products of human activities.

Processes in accordance with the present invention may also prominently feature environmentally benign attributes of energy efficiency, material (e.g., water) conservation and avoids chemical nuisance/toxicity, which, together with the theme of renewable materials products, contribute to the objectives of sustainable ecology.

Figure 1:
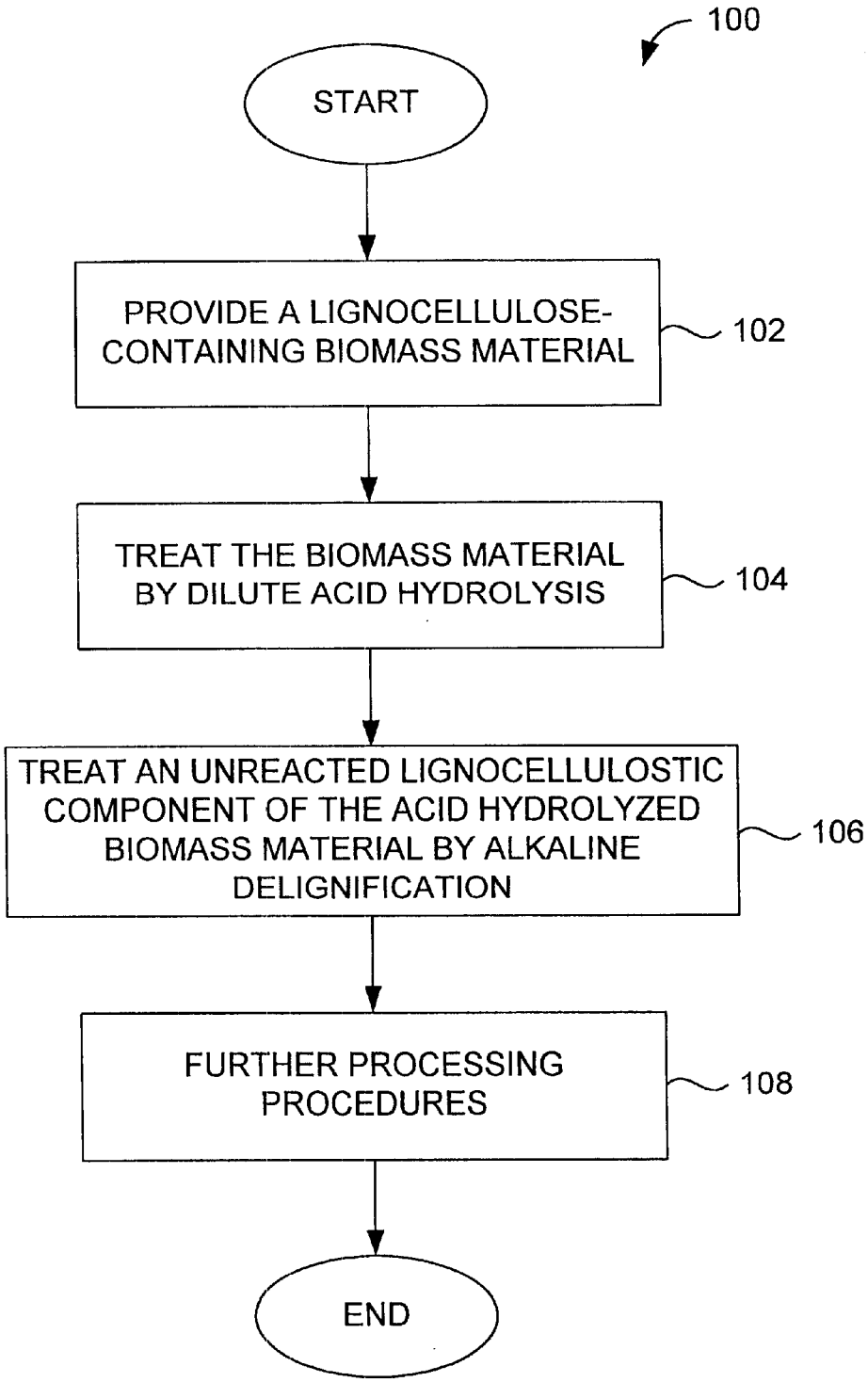
FIG. 1 is a flow chart depicts aspects of a process flow in accordance with a preferred embodiment of the present invention.

FIG. 1 shows a flow chart depicting key stages in a biomass processing method 100 in accordance with the present invention. A biomass feed material is provided to a biomass processing system (102). The biomass is treated by dilute acid hydrolysis (104), for example, as further described below. Following acid hydrolysis, an unreacted lignocellulostic component of the acid hydrolyzed biomass material is treated by alkaline delignification (106). The integration of these two processing techniques results in a substantially increased yield of useful organic products from the starting biomass relative to previous processes. In preferred embodiments, these processing techniques are integrated with further processing techniques (108) such as filtration, internal process recycling, distillation, enzymatic hydrolysis, and bacterial and yeast fermentation in a comprehensive, continuous, high-yield process enabling the production of biodegradable thermoplastic and other useful organic products. As discussed in more detail below, different ordering and combining of these processing techniques may be used to achieve the advantages of the present invention. Two specific embodiments of the present invention are described below with reference to FIGS. 2 and 3.

The starting biomass feed material may be any organic matter, and is generally composed plant material, vegetation, agricultural, industrial or household waste. It may include, without limitation, include one or more of the following: wood, paper, straw, leaves, prunings, vegetable pulp, corn, corn stover, sugarcane, sugar beets, sorghum, cassava, potato waste, bagasse, sawdust and forest mill waste. One common source of biomass feed material for processes in the nature of the present invention is derived from pre- or post-classified mixed municipal solid waste (MSW). The advantages of the present invention are particularly evident where the biomass has a substantial lignocellulostic component. Lignocellulose is a combination of lignin, hemicellulose and cellulose polymers that strengthens woody plant cells. The present invention is particularly well-suited to the processing of lignocellulose-containing biomass (also referred to herein as a lignocellulostic biomass).

IMPLEMENTATION

Preferred embodiments of the present invention incorporate a continuous, interwoven chain of several continuous stages. These may be generically recognized from the biomass ethanol, chemical pulping and separation process literature as including: (1) dilute acid hydrolysis; (2) alkaline delignification; (3) enzymatic hydrolysis; (4) fermentation; and (5) product separation. As noted above, alternative embodiments of the invention may order and, in some cases, combine these stages and variations thereof to implement the invention. Two such embodiments are outlined and then described in detail below.

Embodiment 1

In one embodiment, the present invention is implemented as a five stage process, as follows: (1) dilute acid hydrolysis (hemicellulose); (2) dilute acid hydrolysis (cellulose); (3) alkaline delignification; (4) bacterial fermentation; and (5) yeast fermentation combined with enzymatic hydrolysis. In addition, this process also involves intertwined product separation and recovery and the recycling of useful process facilitators, such as water and enzymes. This embodiment is further described below with reference to FIG. 2.

Figure 2:
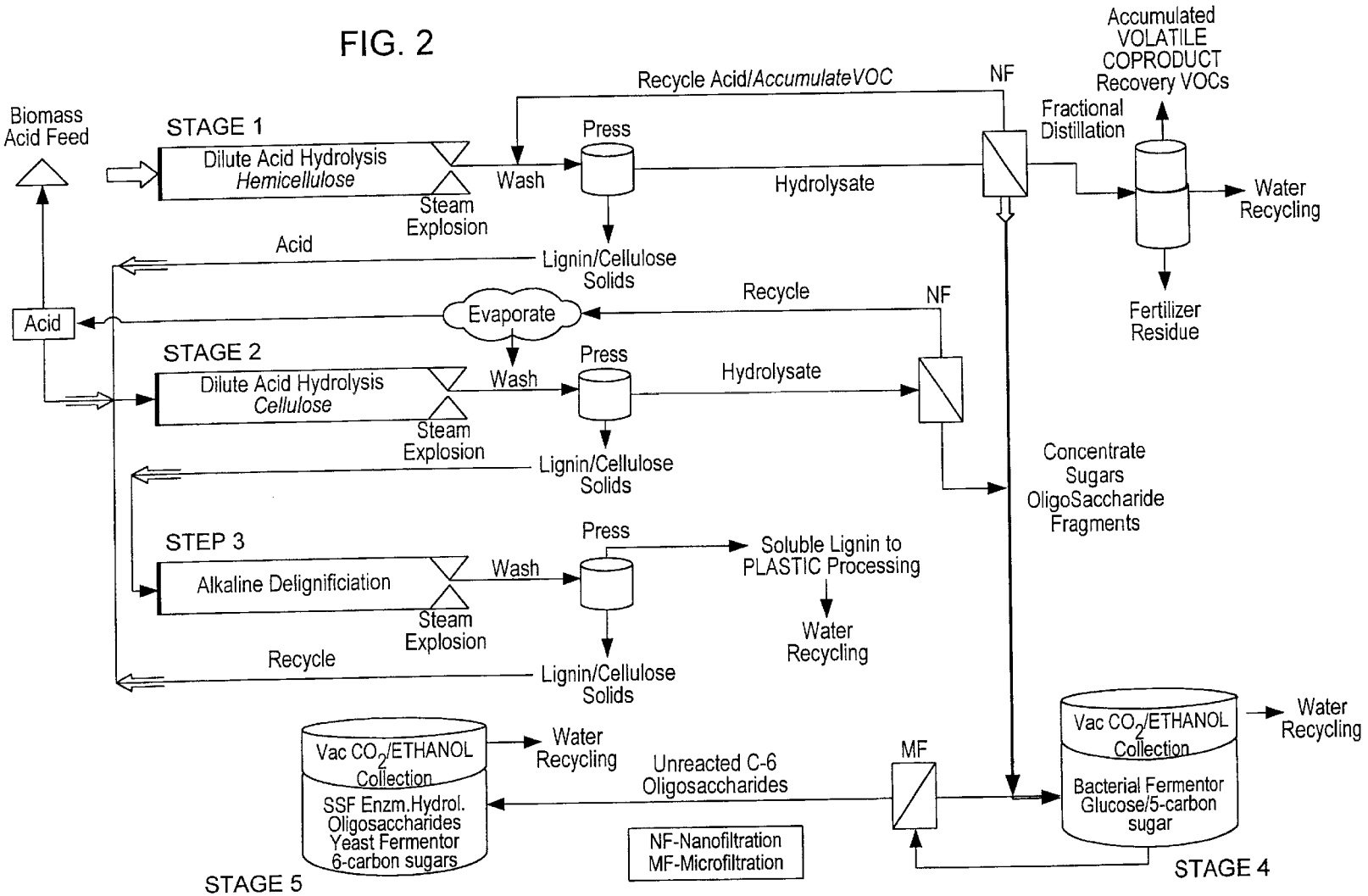
FIGS. 2 and 3 are schematic illustrations of process flows for the production of organic products from diverse lignocellulostic biomass sources in accordance with preferred embodiments of the present invention.

Referring to FIG. 2, a lignocellulose-containing biomass feedstock is prepared for processing using techniques well known to those of skill in the art. The feedstock is ground, screened, and prewashed to remove parasitic dirt. The dirt is settled and may be used for soil amendment. The prewash water is recyled for subsequent use in the biomass processing. The pre-processed biomass is then dewatered.

The dewatered biomass feedstock is subjected to an acid presoak under warm water conditions. The use of nitric acid in the presoak and subsequent hydrolysis, for example, reduces employee hazard and enables employing low-cost, corrosion-resistant stainless steel reactors. The acid presoaked biomass is spun dry, and then further dried by solar/waste heat to about 50% solids.

Stage 1—Dilute Acid Hydrolysis (Hemicellulose)

The first stage of this process in accordance with the present invention involves dilute acid hydrolysis of cellulosic polymer chains in the pre-treated lignocellulosic biomass feedstock, using strong acids, such as nitric or sulfuric. The result is to hydrolyze, solubilize and substantially convert to monomeric sugars most of the polysaccharide constituents of hemicellulose and a small portion, most easily hydrolyzed fraction of cellulose contained in the lignocellulosic feedstock material.

Stage 1 of this embodiment involves dilute acid hydrolysis of the pre-treated biomass feedstock. Exemplary conditions for this hydrolysis are about 0.4% $HNO_3$, at about 195° C. for about 5 minutes in a saturated steam environment within a pressure reactor such as is commonly employed in the pulping industry. Stage 1 is preferably terminated by rapid pressure release (steam explosion) and will solubilize and liberate about one-third of the material of the feedstock. The liquid hydrolysate and solids are then washed and pressed.

Following the Stage 1 dilute acid hydrolysis, a first product separation and recovery is conducted. The Stage 1 liquid hydrolysate is washed and pressed repeatedly from the residual solids to recover about 95% of the liberated sugars, polysaccharide fragments and coproduct volatile organic compounds-such as acetic acid, furfural and hydroxymethylfurfural. The resulting press liquid comprising nominally six times the biomass feed contains solubilized product in about 5% concentration. The liquid is conveyed to a reservoir from which it is passed through nanofiltration (NF) membranes with a standard molecular weight cutoff designed to concentrate and contain the sugars. The concentrated retentate from the NF separation contains the free sugars at nominally 20% concentration and polysaccharide fragments, which are conveyed to the Stage 4 bacterial fermentation process, to be described. The NF permeate contains volatile organics, along with dilute acid catalyst. Importantly, the economics of the process may be enhanced by recycling the permeate back through the Stage 1 wash cycles in successive iterations of the process, conserving acid and accumulating and concentrating VOC coproducts prior to their recovery.

Stage 2—Dilute Acid Hydrolysis (Cellulose)

The lignin/cellulose solids from the press of stage 1 are passed to Stage 2, a second dilute acid hydrolysis stage. To the solids are added 2% acid (e.g., nitric ($HNO_3$) (preferred), sulfuric or hydrocloric) at about 210° C. for about 7 minutes in a saturated steam environment within a pressure reactor. This more rigorous dilute acid hydrolysis is effective to disrupt the cellulose bonds following the more moderate conditions of Stage 1 which are effective to disrupt the more easily hydrolyzed hemicellulose. Like Stage 1, Stage 2 is preferably terminated by rapid pressure release (steam explosion) and will solubilize and liberate about half of the material from the Stage 1 press. The hydrolysate and solids are then washed and pressed to about 50% solids.

Following the Stage 2 dilute acid hydrolysis, a further product separation and recovery is conducted. The Stage 2 liquid hydrolysate is washed and pressed repeatedly from the residual solids to recover about 95% of the liberated sugars, oligosaccharide fragments, acid and additional coproduct volatile organic compounds—such as hydroxymethylfurfural. As in Stage 1, the resulting press liquid is conveyed to a reservoir from which it is passed through nanofiltration (NF) membranes. The concentrated retentate from the NF separation contains the free sugars at nominally 20% concentration and polysaccharide and oligosaccharide fragments, which together are conveyed to the Stage 4 bacterial fermentation process, to be described.

Through the nanofiltration process on the Stage 1 and 2 hydrolysates separation of the depolymerized sugar and oligosaccharide (polymer fragment) from the stream of the process is facilitated. The aqueous permeate of nanofiltration is effectively reconcentrated by vacuum distillation for recycling the acid catalyst to the hydrolysis process stages. Importantly, the reconcentrated catalyst will also be recognized to contain the solubilized fraction of volatile organic chemicals that are liberated by the hydrolysis process in approximately 5% concentration weight/weight at each step of the biomass processing. Thus, after several steps of processing, recovering and concentrating the catalyst carrier and VOCs, a substantial accumulation of VOC products is effected in the catalyst. When this accumulation is judged cost effective to recover, the VOCs may be extracted by fractional distillation, as noted above.

A further advantage of the two-stage dilute hydrolysis of this embodiment of the present invention is the economic efficiency obtained in temporal utilization of tankage. As the result of the two-stage dilute acid hydrolysis, the bulk of the cellulose in the biomass feedstock is effectively decomposed in order minutes rather than days, as has previously been the standard for enzymatic hydrolysis.

Stage 3—Alkaline Delignification

Stage 3 of the process employs chemical delignification of the lignocellulosic solids from the press of Stage 2. Chemistries of the pulp and paper industry that have not previously been integrated with acid dehydrolysis and used in connection with the processing of lignocellulostic biomass are adopted. The preferred embodiment for environmental benefits adopts sulfur-free alkaline delignification from so-called "alkaline pulping" chemistry. Stage 2 solids may be combined with about 4% strong base (such as alkali or other lignin-dissolving base) at about 210° C. for about 4 minutes. The alkaline process may be effectively catalyzed by the use of accelerators such as anthraquinone and tetrahydroanthraquinone. The process chemistries of this stage are well known to those of skill in the art and are detailed in the industry literature, by Sjöström, Eero. *Wood chemistry fundamentals and applications*, 2d. ed. New York: Academic Press, 1993, the disclosure of which is incorporated by reference herein in its entirety and for all purposes.

In processes in accordance with the present invention, as distinct from the classical pulping application, the prior removal of most of the hemicellulose and a major cellulose fraction, with steam explosion to disruptively expand the fiber matrix before delignification, serves both to preserve chemical value of easily degraded hemicellulose while rendering very accessible to pulping chemicals the lignin component of the plant cell walls within the exposed fiber matrix. Further, important interpolymeric chemical bonds are obviated in the dilute acid hydrolysis, solubilization and removal of the cellulosic chemicals. The major result is that lignins are solubilized and washed out of the thus highly disrupted, porous fiber matrix in a characteristic time of minutes rather than hours, as in conventional (wood) pulping.

In a process in accordance with the present invention, and as supported by classical chemical pulping theory, the time constant for delignification decreases (e.g., in kraft pulping) by about a factor of two for each 8° C. increase in temperature. Such rapid temporal performance in delignification as provided here is jointly facilitated by choosing to operate toward the higher end of the temperature range, here also employed in dilute acid hydrolysis, with similarly rapid solubilization and extraction of the hemicellulose. Stage 3 may electively be terminated by either steam explosion or more energy, conserving heat recovery decompression. The product of this stage is then washed and pressed to separate the soluble lignin from the remaining lignin/cellulose solids.

The introduced alkaline delignification stage importantly distinguishes a process in accordance with the present invention from the common practice of biomass ethanol technology involving only dilute acid pretreatment and enzymatic hydrolysis. As shown in testing of pretreated solids in recycle reactor enzymatic hydrolysis, the presence of naturally occurring amounts of lignin with the cellulose in the enzyme recycle reactor results in major, noneconomic declines in enzyme productivity (from cycle to cycle of enzyme reuse against fresh substrate) (Lombard, Charles K., Project Manager, Waste Energy Integrated Systems. *Techno-Economics of the WEIS Biomass Ethanol Process* [Final Report for Project: Enzymatic Utilization of Cellulose in a Continuous Bimembrane Reactor]. National Renewable Energy Laboratory Subcontract No. ACG-7-17021-01, Jun. 26, 1998). Indeed, at moderate enzyme loadings against ligninaceous substrate the effective productivity of an enzyme loading is quickly reduced to a small fraction as compared to performance of the enzyme to repetitively produce depolymerized glucose over several cycles of reuse in companion experiments on lignin-free cellulosic substrate. This observation is consistent with the hypothesis that substantial lignin intertwined in the cellulosic matrix not only interferes with the access of enzyme to the cellulosic polymer chains, but also powerfully attracts and competitively binds enzyme molecules, rendering them unavailable for the cellulose hydrolysis reaction.

Additionally, the economics of the integrated system of this implementation of the present invention with lignin extraction may be effectively doubled against the classical biomass ethanol competition by incorporating the extracted lignin into high-value-adding thermoplastic coproducts according to recently developed processes (Li, Yan and Sarkanen, Simo. Thermoplastics with very high lignin contents (paper presented at American Chemical Society meeting, spring 1998). *ACS Symp. Ser.*, in press; and U.S. Pat. Application of Sarkanen, Simo; and Li, Yan, Compositions based on lignin derivatives, filed Jun. 4, 1999 (Atty. Docket No. 06356/003001) incorporated herein by reference in their entirety and for all purposes).

Lignin-based thermoplastics have adjustable mechanical properties over the range identified with polyethylene, polypropylene and polystyrene are, moreover, biodegradeable. The plastics may be foamed, filmed, cast or extrusion- or injection-molded to satisfy a great variety of applications. To the extent that the polymeric backbone for a lignin-based plastic already exists, energy-intensive synthesis reactions and associated sources of chemical toxicity are avoided. Rather, as taught by Sarkanen, the production of the new plastic only requires a catalytic chemical reaction, e.g., methylation, at normal conditions of temperature and pressure. Thus, there are multiple capital and operations cost savings available in its production.

In another significant performance advance, the Stage 3 washed solids residue is fed back to Stage 2 for subsequent further dilute acid hydrolysis and Stage 3 alkaline delignification to thereby achieve near 100% substrate conversion.

Stages 4 and 5-Fermentation

The concentrated hydrolysate sugars and oligosaccharides of Stages I and II are combined and the glucose and five-carbon sugars are fermented with *Zymomonas mobilis* bacterium in a Stage 4 continuous-flow cascade recycle reactor, blocking and recycling the bacterial catalyst at the outflow while the residual six-carbon sugars and oligosaccharides are passed through a microfilter to a second (yeast) fermenter, discussed below. The ethanol and carbon dioxide products are separated and the remaining six-carbon sugars and oligosaccharides are concentrated by vacuum evaporative distillation from the Stage 4 fermentation reactor.

Complete hydrolysis of the oligosaccharides and fermentation of the residual six-carbon sugars occurs in a Stage 5 continuous-flow simultaneous saccharification and fermentation (SSF) recycle reactor with cellulase enzyme and *Saccharomyces cerevisiae* yeast catalyst (combined yeast fermentation/enzymatic hydrolysis). Separation of ethanol and capture of fermentation $CO_2$ by vacuum evaporative distillation from the SSF reactor is conducted.

Stages 4 and 5 of the process, bacterial fermentation of sugars, also takes place in a continuous recycle reactor comprised of vessels containing separately or jointly provision of biocatalytic agents for fermenting both the five- and six-carbon sugars liberated in Stages 1, 2 and 3 of the process. The practice of Stages 4 and 5 is distinct from prior art in biomass ethanol technology in achieving very high yield with large gains in productivity in both time and tankage realized by: 1) implementing a continuous-flow reactor with feedstock replenishment and product extraction, while 2) employing microfiltration to retain biocatalyst in the reactor to speed the process and 3) optionally making provision for product extracting dilution water to control end-product inhibition in the fermentation process. In the case of the continuously fed SSF enzyme recycle reactor, a nanofiltration membrane can be used to retain catalyst and concentrated sugars in the reactor, while passing residual aqueous carrier.

In one preferred implementation, the use of the robust bacterium *Zymomonas mobilis*, genetically engineered to ferment five-carbon sugars as well as glucose, and the yeast *Saccharomyces cervisiae* together support rapid fermentation of all the six-carbon sugars liberated in the two cellulosic hydrolysis stages. Concentrating the substrate sugars to order 20% in aqueous solution and retaining order 10% biocatalyst loading against the substrate with vacuum evaporative extraction of ethanol and $CO_2$ will realize mean fermentation volume utilization in about one day.

Product Separation and Extraction

As noted above, product separation and extraction is intrtwined with the various stages of the process. Separation of the VOC coproducts is conducted by fractional distillation from the accumulated concentrated VOCs of the Stages 1 and 2 hydrolysate (wash) filter permeate. At VOC harvesting, the residual acid may be neutralized with ammonia or other suitable base to produce, along with other residual mineral salts, a valuable nitrogen-rich fertilizer coproduct.

The use of an NF membrane in the Stage 5 reactor to retain concentrated sugars while accumulating the organic chemical products of hydrolysis represents the beginning of the last instance of intertwined product separation in the process. Those familiar with the art of biomass ethanol technology will recognize that the provisions for high product recovery and separation as provided for the products of Stage 1 dilute acid hydrolysis also synergistically serve to obviate a well-known, important source (acetic acid) of inhibition of the activity of fermentation organisms. Thus the provision of the process to employ filtration to separate the diluted volatile organic chemicals from the resulting concentrated sugars prior to fermentation is a further important advance of the process of the present invention over previous processes.

A major objective of the invention is to build broad flexibility into lignocellulostic biomass processes with regard to value adding product diversity, while maintaining energy efficiency and clean, functional consistency in the face of the fact that many chemical products and coproducts of interest, such as the volatile organic components of the hydrolysate, will have boiling points greater than that of water. Indeed, these coproducts typically pose potential product yield of 17% and product revenues exceeding 20% against the major product, e.g., ethanol, from sugar fermentation, but would imply several times more energy to first boil off all the water for their recovery by traditional distillation. Moreover, it will be appreciated that, while ethanol is a major product opportunity of a process in accordance with the present invention, the design of the processes that explicitly makes concentrated sugars readily accessible alternatively, facilitates both a variety of sugar-based products such as beverages, foods and feed, and through the available agency of a spectrum of different fermentation organisms, a host of alternative chemical products other than ethanol. Such will be recognized to prominently include a number of important organic acids. Accordingly, in the product separation and extraction portions of the process applied to recovery of volatile organic chemicals, including ethanol, efficient solvent extraction may alternatively be invoked to enable product recovery and separation from a higher boiling point medium.

A suitable solvent extraction process is described generically in Perry, Robert H. and Green, Don W., eds. *Perry's Chemical Engineering*, 6th ed., Section 15: Liquid-Liquid Extraction. New York: McGraw-Hill, 1984, which is incorporated by reference herein in its entirety and for all purposes. In the practice of the invention the solvent is chosen to be buoyant and not miscible in water. The solvent is also of higher boiling point than both water and the volatile organic chemicals to be recovered. In the practice of the invention the solvent employed in separation process is further chosen to have a partition coefficient close to unity for both ethanol and the volatile organic liquids. These attributes promote efficient exchange of the hydrolysis products by concentration gradient diffusion into the solvent from the diluted aqueous hydrolysate. Concentration gradient diffusion is classically promoted by employing mixing and causing the feed and solvent streams to flow countercurrently, resulting in spatially extended comparable concentration gradients and high product exchange in a single column.

The product separation and extraction of the process is then concluded with product separation and recovery through fractional distillation from the higher boiling solvent. The solvent so depleted of product is then conservatively recycled back through the solvent extraction process to recover more volatile organic product. The fact that the solvent is chosen both to be buoyant and insoluble in water allows the product-laden solvent to be readily separated from the water on the one hand and, on the other, the product extraction dilution water to be recycled substantially free of solvent back through the fermentation recycle reactor. The recycling of dilution water ultimately recovers loss of product in incomplete single transfer from water to solvent.

Energy conservation is further promoted through the use of solvent extraction because the energy required to distill the major product, e.g., ethanol, from the solvent is substantially less than that expended in distillation from water. Importantly, this savings grows as the concentrations of the organic products in the aqueous carrier is reduced by dilution by order a few percent, e.g., in the interest of diminishing end product inhibition in fermentation. Moreover, another consequence of the present invention that renders it usefully distinct from the current art of biomass ethanol is that virtually all residual water is efficiently removed from the ethanol carrier solvent at an early stage of product recovery (through distillation) and special provisions for "drying," such as molecular sieve, following distillation are obviated.

Embodiment 2

In another embodiment, the present invention is implemented as a five stage process, as follows: (1) dilute acid hydrolysis (hemicellulose); (2) alkaline delignification; (3) enzymatic hydrolysis; (4) fermentation ((a) bacterial fermentation and (b) yeast fermentation); and (5) vacuum evaporative extraction or solvent extraction. In addition, this process also involves product separation and recovery and the recycling of useful process facilitators, such as water and enzymes. This embodiment is further described below with reference to FIG. 3.

Figure 3:
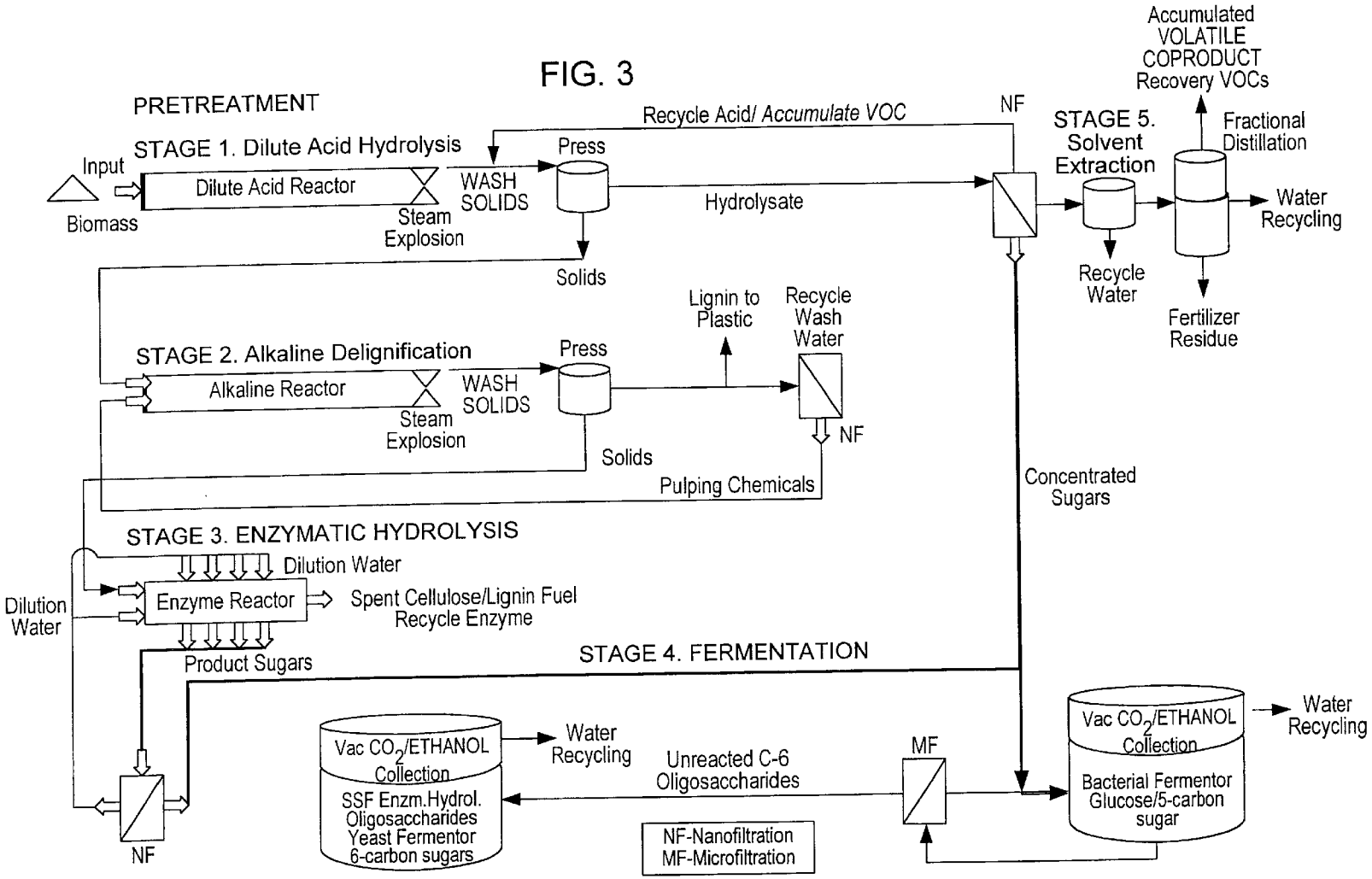

Referring to FIG. 3, a lignocellulose-containing biomass feedstock is prepared and pretreated for processing as described above with reference to FIG. 2.

Stage 1—Dilute Acid Hydrolysis

As with the first embodiment, this embodiment has as it's first stage a dilute acid hydrolysis of cellulosic polymer chains, using strong acids, such as nitric or sulfuric conducted according to similar conditions and parameters described above for Embodiment 1 (e.g., 0.4% $HNO_3$, at about 210° C. for about 4 minutes). The result is to hydrolyze, solubilize and substantially convert to monomeric sugars most of the polysaccharide constituents of hemicellulose and a small portion, most easily hydrolyzed fraction of cellulose contained in the lignocellulosic feedstock material.

Following the Stage 1 dilute acid hydrolysis, the first instance of Stage 5 product separation is conducted. The Stage 1 liquid hydrolysate is washed and pressed repeatedly from the residual solids to recover about 95% of the liberated sugars, polysaccharide fragments and coproduct volatile organic compounds—such as acetic acid, furfural and hydroxymethylfurfural. The resulting press liquid comprising nominally six times the biomass feed contains solubilized product in about 5% concentration. The liquid is conveyed to a reservoir from which it is sequentially passed through microfiltration membranes as in the first embodiment. The retentate from the NF separation contains sugars and polysaccharide fragments which are conveyed to the Stage 4 fermentation process as in Embodiment 1. The NF permeate, which contains the residual acid and volatile organics, is then recycled in the wash to concentrate and accumulate the VOCs through successive iterations of the process prior to accumulated product recovey by fractional distillation. The sugars are concentrated to order 20% for efficient fermentation in Stage 4, to be described.

Stage 2—Alkaline Delignification

Stage 2 of this embodiment employs chemical delignification of the lignocellulosic solids, according to the methods described above for Stage 3 of Embodiment 1. As noted above, the introduced alkaline delignification stage importantly distinguishes a process in accordance with the present invention from the common practice of biomass ethanol technology involving only dilute acid pretreatment and enzymatic hydrolysis.

Stage 3—Enzymatic Hydrolysis

Following separation and recovery of the soluble lignin produced in Stage 2, the remaining solids, water and pulping chemicals are passed to Stage 3. The highly efficient enzymatic hydrolysis process of Stage 3 further distinguishes this embodiment of the present invention from other approaches reported in the literature. Particularly, Gusakov in far-reaching experiments and modeling, showed that the use of flowthrough reactors with continuous product sugar extraction in dilution water could counter so-called "end product inhibition" and improve productivity of enzymatic hydrolysis by orders of magnitude in time and tankage. Further, the experiments of Gusakov (Gusakov, A. V.; Sinitsyn, A. P. and Klyosov, A. A. Factors affecting the enzymatic hydrolysis of cellulose in batch and continuous reactors: computer simulation and experiment. *Biotechnol. Bioeng.* 29: 906–910 (1987); Gusakov, A. V.; Sinitsyn, A. P. and Klyosov, A. A. Kinetics of the enzymatic hydrolysis of cellulose. 2. A mathematical model for the process in a plug-flow column reactor. *Enzyme Microbiol. Technol.* 7: 383–388 (1985); Gusakov, A. V.; Sinitsyn, A. P. and Klyosov, A. A. A theoretical comparison of the reactors for the enzymatic hydrolysis of cellulose. *Biotechnol. Bioeng.* 29: 898–900 (1987); the disclosures of which are incorporated by reference herein in their entirety and for all purposes) crudely demonstrated the economic conservation of costly cellulase enzyme by sequentially capturing and reusing the biocatalyst on new substrate, there made successively accessible downstream. This present invention applies such concepts in the context of modern process technology expressed in flowthrough enzyme recycle reactor hydrolysis of cellulose in commercially viable large-scale implementations.

A major issue and objective of preferred implementations of the present invention is to provide for continuous material replenishment along with both needed mixing of the reactor contents while retaining an ordered separate sense of temporal aging of materials in the reactor. The latter supports the ability to conveniently remove such aged, less reactive and relatively residual-lignin-enriched material in a discriminating manner. A second major issue is how to concurrently provide wide latitude for reactor volume expansion (design) in a continuous-flow configuration while providing conveniently effective local control of dilution water limiting product buildup and end product inhibition in the reactor.

One skilled in the art will realize that the present process objectives are not jointly fulfilled in either, for example, the classical mixing reactor, in which distinction between new and aged substrate is lost and removal of aged unreactive substrate must be either unproductively batch (at the expense of lost time and volume utilization) or at the expense of lost productive material. Nor are the objectives realized in the axial flowthrough column reactor, where resistance to flow with control of sugar concentration must inherently be a challenging function of length, complicated by provisions to retain enzyme in the reactor by filtration, while also removing aged unreactive substrate.

The effective solution practiced in accordance with this embodiment of the present invention is to decouple geometrically the functions (and directions) of material flow control and control of dilution water and product extraction in the enzyme recycle hydrolysis reactor.

In this specific embodiment of the invention the solution is practiced by adopting a new substantially horizontal channel configuration for the enzymatic hydrolysis reactor. In this generic configuration the substrate material flow independently takes place in the horizontal direction along the sense of length of the channel. Accommodation conveniently provided for adding new substrate material at the inflow end of the channel and progressively aged and reacted material removed at the outflow end. Separate provision for dilution water and product extraction can be independently facilitated crossflow (in the material sense) in either or both the width and depth directions, whose dimensions are freely adjustable relative to channel length. Mixing to promote efficient redistribution of biocatalyst on substrate and incorporation of product sugars into dilution water for extraction can naturally be facilitated to take place locally on a scale of the shorter of channel width or depth. The channel geometry provides for effective modular decomposition of scale of design by, for example, replicating parallel channels in the width and/or depth dimensions.

Optionally, in the channel (and other) configurations, extraction of dilution water with product sugars can be effectively facilitated by microfiltration devices positioned at or near the lateral (vertical or horizontal) boundaries. The microfiltration blocks (retain or return to the channel) the cellulosic particulate substrate while the permeate contains freely floating enzymes and product sugars dissolved in the dilution water for subsequent UF and NF filtration with reduced fouling.

It should be understood that alternative implementations of this embodiment of the invention exist. For example, the same geometric decoupling of aqueous carrier/product flow and substrate material flow can also be expressed in other geometries, such as a vertical column reactor with provisions for lateral injection and extraction of aqueous carrier through filtration means located in and about the sides of the column.

At this juncture in the present embodiment the second instance of the intertwined product separation process of Stage 5 is invoked. Here the dilution water extracted from the enzymatic hydrolysis reactor is first nanofiltered through a membrane such as previously employed for the diluted hydrolysate of Stage 1. The freely floating enzyme is collected in the retentate of the UF membrane and returned to the enzyme recycle reactor for reuse. The permeate of UF membrane contains the product sugars of the enzyme recycle hydrolysis reactor. These are next concentrated in the retentate of an NF membrane preparatory to Stage 4 fermentation as otherwise employed for the diluted hydrolysate sugars of Stage 1 of the present process. At this point in the present process the sugar-depleted dilution water permeate of the NF membrane is then efficiently recycled back through the enzymatic hydrolysis reactor to collect more product sugars. The implementation of this aspect of the present invention, the reader is referred to is well understood by those of skill in the art (modem recycle reactor/filtration technology), as described, for example in Cheryan, Munir. *Ultrafiltration handbook*. Lancaster, Pa.: Technomic Publishing Co., 1986, the disclosure of which is incorporated by reference herein in its entirety and for all purposes.

With further regard to practice of the invention, it will be appreciated that the enzyme biocatalyst employed in the hydrolysis reactor will in generality be composed of a combination of cellulases, hemicellulases, amylases and ligninases and these may be either introduced or produced in situ. In the practice of one implementation of this embodiment of the present invention, the continuous-flow hydrolysis reactor is operated at comparatively high substrate solids loading of from nominally 5% to 35%. Moderate enzyme loading is in the range of about 1 to 35 FPU/gm substrate. Volume dilution rate is about 0.1 to 1 per hour. In the preferred practice, substrate loading is about 20%, enzyme loading is about 10 FPU/gm, and dilution rate for product extraction is about 1 per hour. With continuous replacement of converted substrate, the highly productive mean time for volume conversion of cellulose to sugar in the reactor is about one day.

Similarly, as in Embodiment 1, higher yield may be obtained by recycling the aged lignocellulostic residue of the channel reactor back through the alkaline delignification stage.

Stage 4—Fermentation

Stage 4 of the present process, fermentation of sugars, also takes place in a continuous recycle reactor comprised of vessels containing separately or jointly provision in biocatalytic agents for fermenting both the five- and six-carbon sugars liberated in Stages 1 and 3 of the present process. The practice of Stage 4 is distinct from previous approaches used in biomass ethanol technology in achieving very high yield with large gains in productivity in both time and tankage realized by: 1) implementing a continuous-flow reactor with feedstock replenishment and product extraction, while 2) employing microfiltration and NF to retain biocatalyst and concentrated feedstock sugars in the reactor to speed the process, and 3) making provision for product extracting dilution water to control end product inhibition in the fermentation process. As in Embodiment 1, the yeast reactor may be operated SSF with cellulase enzyme to clean up the hydrolyzed oligosaccharide fragments. Again, ethanol and $CO_2$ can be efficiently vacuum evaporative extracted from the fermenters.

In one preferred embodiment, the use of the robust bacterium *Zymomonas mobilis*, genetically engineered to ferment five-carbon sugars as well as glucose, and the yeast *Saccharomyces cervisiae* support rapid fermentation of all the five- and six-carbon sugars liberated in the two cellulosic hydrolysis steps. Concentrating the substrate sugars to order 20% in aqueous solution and retaining order 20% biocatalyst loading against the substrate with a comparatively low dilution water volumetric exchange rate of order 0.1 per hour will realize mean fermentation volume utilization in about one day, efficiently matching the performance of the enzymatic hydrolysis step.

Stage 5—Product Extraction

The use of the NF membrane to retain concentrated sugars while extracting carrier water from the recycle reactors of Stage 4 represents the beginning of the last instance of intertwined Stage 5 product separation in the present process. As noted above, those familiar with the art of biomass ethanol technology will recognize that the provisions for high product recovery and separation as provided for the products of Stage 1 dilute acid hydrolysis also synergistically serve to obviate a well-known, important source (acetic acid) of inhibition of the activity of fermentation organisms. Thus the provision of the present process to employ filtration to separate the diluted volatile organic chemicals from the resulting concentrated sugars prior to fermentation also renders the present process distinct from previous approaches.

Again, as noted above with respect to Embodiment 1, a major objective of the invention is to build broad flexibility into the present process with regard to value adding product diversity, while maintaining energy efficiency and clean, functional consistency in the face of the fact that many chemical products and coproducts of interest, such as the volatile organic components of the Stage 1 hydrolysate, will have boiling points greater than that of water. Accordingly, the same product recovery, including fractional distillation and possibly solvent extraction are applied here as were described above with reference to Embodiment 1. The same economic, energy and environmentally sound practices discussed with reference to Embodiment 1 are also preferably applied here.

Systems

The systems used to implement processes in accordance with the present invention will be well understood to those of skill in the art given the process descriptions provided herein. The invention may be implemented using conventional biomass processing apparatus configured to operate in accordance with the invention.

EXAMPLES

Various experiments were conducted and results abstracted from the literature to demonstrate the performance advantages provided by sample implementations of the present invention in comparison to prior processes. It should be understood that the experiments described in the following examples are representative only and in no way limit the scope of the present invention.

The effectiveness of processes in accordance with the present invention may be illustrated with reference to a body of experimental data consistent with theoretical models derived from the paper pulping and fermentation industries. In particular, a body of mutually consistent test results in the hydrolysis of a variety of common lignocellulosic wastes representative of municipal solid waste (MSW) have been assembled. The relevant findings reported by Brink for tests averaged over hardwood, softwood and mixed paper feedstock, and by Nguyen (Nguyen, Quang A.; Keller, Fred A.; Tucker, Melvin P.; Lombard, Charles K.; Jenkins, Bryan A.; et al. Bioconversion of mixed solid waste to ethanol. *Applied Biochem. Biotechnol.* 77–79: 455–472, 1999) for tests on a mixed feedstock composed of comparable amounts of woodwaste, orchard prunings, straw and mixed paper are summarized below. These tests collectively represent twenty years of thoroughly established practice in the art of dilute acid hydrolysis of lignocellulosic materials in a variety of moderate pressure (10–20 atmosphere) reactor systems. These tests, among a much larger body of literature, reveal that results, while definitely time, temperature and pressure dependent, have a comfortable physical consistency from which a modest program of rational engineering design testing of the a process augmented and implemented in accordance with the present invention can confidently proceed.

The tests in question involve two-stage dilute acid hydrolysis by Brink using nitric acid and single-stage dilute acid hydrolysis of Nguyen using sulfuric acid. Both acids are similarly efficacious from a hydrolysis standpoint. The two-stage approach is founded in the understanding first that hemicellulose is more readily hydrolyzed under milder conditions of pressure, temperature and acid concentration than cellulose. Second, glucose (derived principally from cellulose) is more resistant to chemical degradation after depolymerization than xylose, the principal product of hemicellulose.

Nguyen has provided the analysis of chemical composition of (the representative) mixed feedstock in wt %:

| G | X | GA | A | M | LG | Ash | U |
|---|---|---|---|---|---|---|---|
| 41.7 | 13.3 | 0.8 | 1.8 | 5.3 | 24.2 | 4.8 | 8.1 |
| 44 | 14.2 | 0.8 | 1.9 | 5.5 | 25.5 | 5 | 3 |

(where the polysaccharide constituents of cellulose and hemicellulose are labeled G for glucan, X for xylan, GA for galactan, M for mannan, KG for lignin and U for unidentified). Based on typical compositions of plant materials, in the second row of the table 5 wt % of the unidentified category has been reasonably redistributed to the polysaccharides, lignin and ash approximately pro rata, based on the observed composition. The remaining 3 wt % could reasonably represent proteins and extractives from the plant sources. With this adjustment, the cellulose is estimated at 41 wt % and the hemicellulose at 25.5 wt % in good conformity with nominal plant compositions.

Based on 51% fermentation conversion of sugars to ethanol and 49% to $CO_2$, the theoretical yield of the feedstock is about 102 gal/ton of lignocellulosic biomass. In technoeconomic analysis of a process in accordance with Embodiment 2 in accordance with the present invention and based on these material compositions, we conservatively project process yield of 87% for ethanol and 80% for lignin plastic and volatile organic compound (VOC) coproducts.

The results of the tests of Brink and Nguyen in support of the advantages of a process in accordance with the present invention are as follows:

TABLE 1

Results of Stage 1 Dilute Acid Hydrolysis Tests (Wt %)

| Product | Brink | Nguyen |
|---|---|---|
| Hydrolysate (solubles) | 29 | 34 |
| Solids | 71 | 66 |
| Hexose | 7.3 | 9 |
| Pentose | 8.4 | 5.9 |
| Total Sugars | 15.7 | 14.9 |
| AC | 2.7 | 2.5 |
| FF | 0.7 | 1.4 |
| HMF | — | 1.6 |
| Total VOC's | 3.4 | 5.5 |

TABLE 1-continued

Results of Stage 1 Dilute Acid Hydrolysis Tests (Wt %)

| Product | Brink | Nguyen |
|---|---|---|
| TOTAL SUGARS PLUS VOCs | 19.1 | 20.4 |
| UNRESOLVED SOLUBLES | 10 | 13.6 |

(VOCs—AC, acetic acid; FF, furfural; HMF, hydroxymethylfurfural)

TABLE 2

Results of Stage 2 Dilute Acid Enzymatic Hydrolysis Tests

| Product | Brink | Nguyen |
|---|---|---|
| Hydrolysate | 37.5 | 32.4 |
| Solids | 40 | 33.6 |
| Hexose | 26.1 | 32.4 |
| Pentose | — | — |
| Total Sugars | 26.1 | 32.4 |
| AC | — | — |
| FF | — | — |
| HMF | 1.2 | — |
| Total VOC's | 1.2 | — |
| TOTAL SUGARS PLUS VOCs | 27.3 | 32.4 |
| UNRESOLVED SOLIDS | 13.6 | 3.0 |

Discussion of Testing Results

Despite the fact that Nguyen chose to employ somewhat more severe hydrolysis conditions with dilute acid yielding qualitatively predictable results compared to Brink's, nonetheless, the net result of Stage 1 pretreatment by the two independent groups and tests are persuasively similar. These indicate a mature technology under control. Accounting for the 30% lignin and ash, the unresolved products of the two-stage dilute acid hydrolysis process of Brink total 23% of the feedstock and are believed composed of a combination of unreacted cellulose and partially hydrolyzed oligosaccharides. The enzymatic hydrolysis experiments of Nguyen with total 16.6% solids unresolved support more complete hydrolysis of cellulosic chemicals, results also confirmed by Brink in second stage SSF enzymatic hydrolysis.

Since cellulases are in fact well known combinations of enzymes that work by attaching polysaccharide chains both in mid-chain and near the ends, they do their work inherently by repetitively fractionating the polymeric chemicals and ultimately their oligosaccharide fragment products.

One advantage of a process in accordance with the present invention which uses two-stage dilute acid hydrolysis followed by enzymatic hydrolysis (e.g., the process described with reference to FIG. 2, above) is that most of the work of breaking up the cellulosic chains is more easily accomplished by the acid, giving the enzyme an open field to polish off the uncompleted work at low cost in catalyst and facilities in conjunction with the simple SSF oligosaccharide/yeast fermentation reactor. By contrast, as described in Lombard (reference 10), when enzymes are used directly in place of a cellulose prehydrolysis with dilute acid, the still structurally complex solids (cellulosic chains) present a challenge to the enzymes to penetrate, particularly when substantial lignin is present to shield cellulose and compete for adsorption of enzyme catalyst. Finally, through both acid fractionating most of the cellulose and alkali removing most of the lignin, essentially all with the Stage 2 and 3 iterative extraction processes, the scope of the residual enzymatic hydrolysis problem of Embodiment 1 can be inferred to be from the test results to be reduced from about 23% to about 10% in both size and complexity. For example, there are no longer macroparticles of cellulose to pose filter-clogging problems in the enzyme recycle reactor of the prior work of Lombard (reference 10).

Moreover, because the volume of material to be enzymatically digested in Embodiment 1 is reduced by an order of magnitude relative to Embodiment 2, similar reductions in the volume of costly enzyme and, most importantly, large reductions in dilution water needed to control end-product inhibition, are possible. The latter problem with heretofore brute-force enzymatic hydrolysis (i.e., without second-stage acid prehydrolysis) is extensively discussed Lombard (reference 10). The dilution water problem, which can require massive volumes of filtration, is here further obviated by the use of SSF (simultaneous saccharification and fermentation) in processes in accordance with one embodiment of the present invention to remove competing sugars from the reactor by fermentation in pace with their production by enzymatic hydrolysis.

Prior processes, without the advances provided by the present invention, such as hybrid dilute acid/enzymatic hydrolysis, for example, as practiced by Brink with SSF, has achieved 90% yields in a process of several days. The enzymatic hydrolysis of cellulose experiments of Shoemaker described and analyzed in Lombard (reference 10) project one-day mean volume utilization with one stage of dilute acid, one stage of alkaline delignification, and a third stage of enzymatic hydrolysis, as in Embodiment 2. Before adding the second-stage dilute acid hydrolysis, the earlier projected temporal performance posed rather daunting requirements for filtration, both in dilution water exchanges in the enzyme recycle reactor to lower product sugar concentrations, followed by subsequent filtration to reconcentrate sugars for efficient fermentation and distillation.

In accordance with the present invention, about 90% of the sugars are both generated by acid hydrolysis and efficiently fermented over nominally a day in the bacterial system, leaving only about 10% of the problem for the SSF reactor. For the reasons discussed, the SSF recycle reactor, with easily hydrolysable oligosaccharides and concentrated yeast and enzyme catalyst, can be given all the performance desired at very modest cost in infrastructure and overhead.

References

U.S. Patent Documents

| | | |
|---|---|---|
| 1. Dreer | U.S. Pat. No. 4,110,281 | August 1978 |
| 2. Fuqua et al. | U.S. Pat. No. 5,709,796 | January 1998 |
| 3. Tyson | U.S. Pat. No. 5,705,216 | January 1998 |
| 4. Huber | U.S. Pat. No. 4,728,367 | March 1988 |
| 5. Brink | U.S. Pat. No. 5,221,357 | June 1993 |
| 6. Brink et al. | U.S. Pat. No. 4,706,903 | November 1987 |
| 7. Brink | U.S. Pat. No. 5,628,830 | May 1997 |
| 8. Tedder | U.S. Pat. No. 5,036,005 | July 1991 |

Other References

9. Sjöström, Eero. *Wood chemistry fundamentals and applications*, 2d. ed. New York: Academic Press, 1993.
10. Lombard, Charles K., Project Manager, Waste Energy Integrated Systems. *Techno-Economics of the WEIS Bio-*

*mass Ethanol Process* [Final Report for Project: Enzymatic Utilization of Cellulose in a Continuous Bimembrane Reactor]. National Renewable Energy Laboratory Subcontract No. ACG-7-17021-01, Jun. 26, 1998.

11. Gusakov, A. V.; Sinitsyn, A. P. and Klyosov, A. A. Factors affecting the enzymatic hydrolysis of cellulose in batch and continuous reactors: computer simulation and experiment. *Biotechnol. Bioeng*. 29: 906–910 (1987).
12. Gusakov, A. V.; Sinitsyn, A. P. and Klyosov, A. A. Kinetics of the enzymatic hydrolysis of cellulose. 2. A mathematical model for the process in a plug-flow column reactor. *Enzyme Microbiol. Technol*. 7: 383–388 (1985).
13. Gusakov, A. V.; Sinitsyn, A. P. and Klyosov, A. A. A theoretical comparison of the reactors for the enzymatic hydrolysis of cellulose. *Biotechnol. Bioeng*. 29: 898–900 (1987).
14. Li, Yan and Sarkanen, Simo. Thermoplastics with very high lignin contents (paper presented at American Chemical Society meeting, spring 1998). *ACS Symp. Ser*., in press.
15. Cheryan, Munir. *Ultrafiltration handbook*. Lancaster, Pa.: Technomic Publishing Co., 1986.
16. Perry, Robert H. and Green, Don W., eds. *Perry's Chemical Engineering*, 6th ed., Section 15: Liquid-Liquid Extraction. New York: McGraw-Hill, 1984.
17. Nguyen, Quang A.; Keller, Fred A.; Tucker, Melvin P.; Lombard, Charles K.; Jenkins, Bryan A.; et al. Bioconversion of mixed solid waste to ethanol. *Applied Biochem. Biotechnol*. 77–79: 455–472, 1999.

All references cited in this application are incorporated by reference for all purposes.

Conclusion

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method of processing a lignocellulose-containing biomass material, comprising:

treating the biomass material by one or more stages of dilute acid hydrolysis with about 0.4% to 2% strong acid; and treating an unreacted solid lignocellulostic component of the acid hydrolyzed biomass material by alkaline delignification to produce precursors for biodegradable thermoplastics and derivatives.

2. The method of claim 1, further comprising fermentation treatment of at least one member selected from the group consisting of free sugars, polysaccharides and oligosaccharides produced by said dilute acid hydrolysis treatment.

3. The method of claim 2, further comprising enzymatic hydrolysis of at least one of polysaccharides and oligosaccharides produced by said dilute acid hydrolysis treatment.

4. The method of claim 2, further comprising fractional distillation of volatile organic compounds produced by said dilute acid hydrolysis treatment.

5. The method of claim 1, wherein said dilute acid hydrolysis treatment comprises a first stage of combining a lignocellulostic biomass with about 0.4% strong acid, at about 185° C. for about 5 minutes in a saturated steam environment within a pressure reactor.

6. The method of claim 5, further comprising terminating said hydrolysis stage by a rapid pressure release.

7. The method of claim 5, wherein said dilute acid hydrolysis treatment further comprises a second stage of combining lignin/cellulose solids produced by said first stage with about 2% strong acid at about 210° C. for about 7 minutes in a saturated steam environment within a pressure reactor.

8. The method of claim 7, further comprising terminating said hydrolysis stage by a rapid pressure release.

9. The method of claim 1, wherein said alkaline delignification treatment comprises combining solids produced by said acid hydrolysis treatment with about 4% strong base at about 210° C. for about 4 minutes.

10. The method of claim 9, wherein said process is catalyzed by at least one member selected from the group consisting of anthraquinone and tetrahydroanthraquinone.

11. The method of claim 1, wherein said alkaline delignification treatment product material comprises water soluble lignin.

12. The method of claim 2, wherein said fermentation treatment comprises a bacterial fermentation and a yeast fermentation.

13. The method of claim 3, wherein said enzymatic hydrolysis of cellulose is conducted independently in a continuous flow enzymatic hydrolysis reactor.

14. The method of claim 12, wherein said yeast fermentation is combined with enzymatic hydrolysis (SSF).

15. The method of claim 12, wherein said bacterial fermentation is conducted aerobically by genetically engineered *Zymomonas mobilis* bacteria in a flow-through reactor.

16. The method of claim 12, wherein said yeast fermentation is conducted with *Saccharomyces cerevisiae*.

17. The method of claim 13, wherein said enzymatic hydrolysis is conducted using a cellulase enzyme.

18. The method of claim 14, wherein said combined yeast fermentation and enzymatic hydrolysis is conducted using *Saccharomyces cerevisiae* and a cellulase enzyme.

19. The method of claim 1, further comprising solvent extraction.

20. The method of claim 1, further comprising intertwined product separation and extraction processes to recover useful organics from the process.

21. The method of claim 1, wherein said dilute acid hydrolysis is conducted using nitric acid with internal recyling, and further comprising conversion of said nitric acid to nitrate fertilizer by addition of base following its repeated use in the biomass processing.

22. The method of claim 1, wherein said biomass is derived from mixed municipal solid waste.

23. The method of claim 1, wherein said biomass comprises at least one member selected from the group consisting of wood, paper, straw, leaves, prunings, vegetable pulp, corn, corn stover, sugarcane, sugar beets, sorghum, cassava, potato waste, bagasse, sawdust and forest mill waste.

24. The method of claim 1, wherein the biomass material contains greater than 10% by weight of at least one of free sugars and starches that may be readily steam extracted or enzymatically converted to sugars for extraction in advance of processing of a lignocellulosic material fraction.

25. The method of claim 2, further comprising recycling of process facilitators including water, acid, base and bacteria, yeast and enzymes.

26. The method of claim 11, wherein the soluble lignin is subsequently integrated in a biodegradable lignin-based thermoplastic.

27. A method of processing a lignocellulose-containing biomass material, comprising:

treating the biomass material by a first stage or dilute acid hydrolysis with about 0.4% strong acid;

treating lignin/cellulose solids produced by said first stage of dilute acid hydrolysis by a second stage of dilute acid hydrolysis with about 2% strong acid;

treating an unreacted lignocellulostic component of the acid hydrolyzed biomass material produced by the second acid hydrolysis stage by alkaline delignification;

treating at least one member selected from the group consisting of free five- and six-carbon sugars and oligosaccharides produced by said dilute acid hydrolysis stages by bacterial fermentation;

treating at least one of six-carbon sugars and oligosaccarides produced by said dilute acid hydrolysis stages and unreacted in said bacterial fermentation treatment by combined yeast fermentation and enzymatic hydrolysis (SSF); and conducting separation and recovery of useful organic products intertwined with the treatment stages of said processing.

28. The method of claim 27, further comprising internal recycling of water and acid catalysts during said processing.

29. The method of claim 27, further comprising treating washed and pressed product of the first and second acid hydrolysis stages by nanofiltration to concentrate and separate free sugars and oligonucleotide fragments for subsequent fermentation, and enable the vacuum evaporative concentration of residual acid catalyst and accumulated volatile organic compounds through iterations of the process.

30. The method of claim 29, further comprising periodic harvesting of neutralized acid salts and accumulated volatile organic compounds.

31. The method of claim 29, wherein said neutralized acid salts constitute fertilizer.

32. A method of processing a lignocellulose-containing biomass material, comprising:

treating the biomass material by one or more stages of dilute acid hydrolysis with about 0.4% to 2% strong acid;

treating an unreacted lignocellulostic component of the acid hydrolyzed biomass material produced by the acid hydrolysis stage by alkaline delignification;

treating at least one of the unreacted polysaccharides and oligosaccharides produced by said dilute acid hydrolysis stage by enzymatic hydrolysis;

treating at least one member selected from the group consisting of free five- and six-carbon sugars, polysaccharides and oligosaccharides produced by said dilute acid hydrolysis and enzymatic hydrolysis stages by bacterial fermentation;

treating at least one of six-carbon sugars and oligosaccarides produced by said dilute acid hydrolysis and enzymatic hydrolysis stages by combined yeast fermentation combined yeast and enzymatic hydrolysis (SSF); and conducting separation and recovery of useful organic products intertwined with the treatment stages of said processing.

33. The method of claim 1, further comprising washing and pressing the hydrosylate of the acid hydrolyzed biomass material to recover at least one of the group consisting of liberated sugars, oligosaccharide fragments, polysaccharide fragments and volatile organic compounds.

34. The method of claim 33, further comprising nanofiltering the washed and pressed hydrosylate to concentrate at least one of the group consisting of liberated sugars, oligosaccharide fragments and polysaccharide fragments.

35. The method of claim 34, further comprising bacteria fermentation of the concentrate.

* * * * *